US005895315A

United States Patent [19]

Pinder, Jr.

[11] Patent Number: 5,895,315

[45] Date of Patent: Apr. 20, 1999

[54] RECOVERY DEVICE FOR POLISHING AGENT AND DEIONIZING WATER FOR A POLISHING MACHINE

[76] Inventor: Harvey Wayne Pinder, Jr., No. 12, Alley 4, Lane 6, Fu Chun St., Hsin Chu City, Taiwan

[21] Appl. No.: 08/908,305

[22] Filed: Aug. 7, 1997

[51] Int. Cl.[6] ..... B24B 57/00

[52] U.S. Cl. ..... 451/60; 451/41; 451/36; 451/446

[58] Field of Search ..... 451/60, 41, 36, 451/446

[56] References Cited

U.S. PATENT DOCUMENTS

| | | | |
|---|---|---|---|
| 5,538,462 | 7/1996 | Gnadt | 451/60 |
| 5,755,614 | 5/1998 | Adams et al. | 451/60 |
| 5,775,980 | 7/1998 | Sasaki et al. | 451/60 |
| 5,791,970 | 8/1998 | Yueh | 451/60 |
| 5,799,643 | 9/1998 | Miyata et al. | 451/60 |
| 5,800,251 | 9/1998 | Nakazato et al. | 451/60 |

*Primary Examiner*—Robert A. Rose
*Assistant Examiner*—George Nguyen
*Attorney, Agent, or Firm*—Abelman, Frayne & Schwab

[57] ABSTRACT

A recovery device for a polishing agent and deionizing water for a polishing machine is disclosed. Especially, a recovery device fitted to a drain conduit of a waste polishing agent produced from a chemical-mechanical polishing (CMP) machine to recover the used polishing agent and/or the deionizing water used in the procedure of polishing. The recovery device comprises essentially an electromagnetic valve controlled by a control electronic unit which receives the signals from the chemical mechanical polishing (CMP) machine.

6 Claims, 1 Drawing Sheet

RECOVERY DEVICE FOR POLISHING AGENT AND DEIONIZING WATER FOR A POLISHING MACHINE

The present invention relates to a recovery device for a polishing agent and deionizing water for a chemical-mechanical polishing machine.

BACKGROUND OF THE INVENTION

Conventionally, the uniformity of a semiconductor device is achieved by processes of masking and etching or by a process of polishing with a chemical-mechanical polishing machine. Preference is given to the process of polishing with a chemical-mechanical polishing (CMP) machine. The process of polishing by chemical-mechanical polishing essentially comprises the steps of holding the semiconductor device by holding means and polishing with a spinning polishing pad, to get rid of the an excess portion of the semiconductor device or to get a uniform thickness for the semiconductor device. In order to enhance the efficacy of polishing, a polishing slurry must be continuously added to the polishing pad. Additionally, during the period of being not used, deionizing water must be added so as to maintain the wetness of the polishing pad and to facilitate the proceeding of further polishing. Conventionally, the used polishing slurry and deionizing water are collected and drained out to a waste liquid storage tank. Nowadays, the process of chemical mechanical polishing is used more frequently, and accordingly, the amount of the used polishing slurry and deionizing water is getting greater. Further, the cost of the polishing slurry and deionizing water per se and the treatment of the used polishing slurry and deionizing water are relatively high, thus the recovery and re-use of the used polishing slurry and deionizing water is more important than ever.

SUMMARY OF THE INVENTION

The present invention relates to a recovery device for polishing slurry and deionizing water for a chemical mechanical polishing machine, which is fitted to a drain conduit of the chemical mechanical polishing machine, and is essentially composed of pumps, electromagnetic valves, a storage tank, filters and a control electronic unit. More particularly, the present invention relates to a recovery device for polishing slurry and deionizing water for a chemical mechanical polishing machine, and comprises:

- a control electronic unit, which receives signals from said polishing machine to control a control valve;
- a storage tank for said polishing agent, which receives said waste polishing agent from said drain conduit;
- a first filter for said polishing agent, which filters said waste polishing agent from said storage tank; after filtration, said filtered waste polishing agent is sent back to said polishing machine;
- a second filter for deionizing water, which receives and filters said deionizing water from said polishing machine; after filtration, said deionizing water is sent to a recovery system for deionizing water;
- a plurality of control valves which are separately disposed between said polishing machine and said storage tank for said waste polishing agent, and at an outlet of said storage tank for said waste polishing agent, and which are controlled by said control electronic unit.

DETAILED DESCRIPTION OF THE PREFERRED EMBODIMENTS

Figure 1:
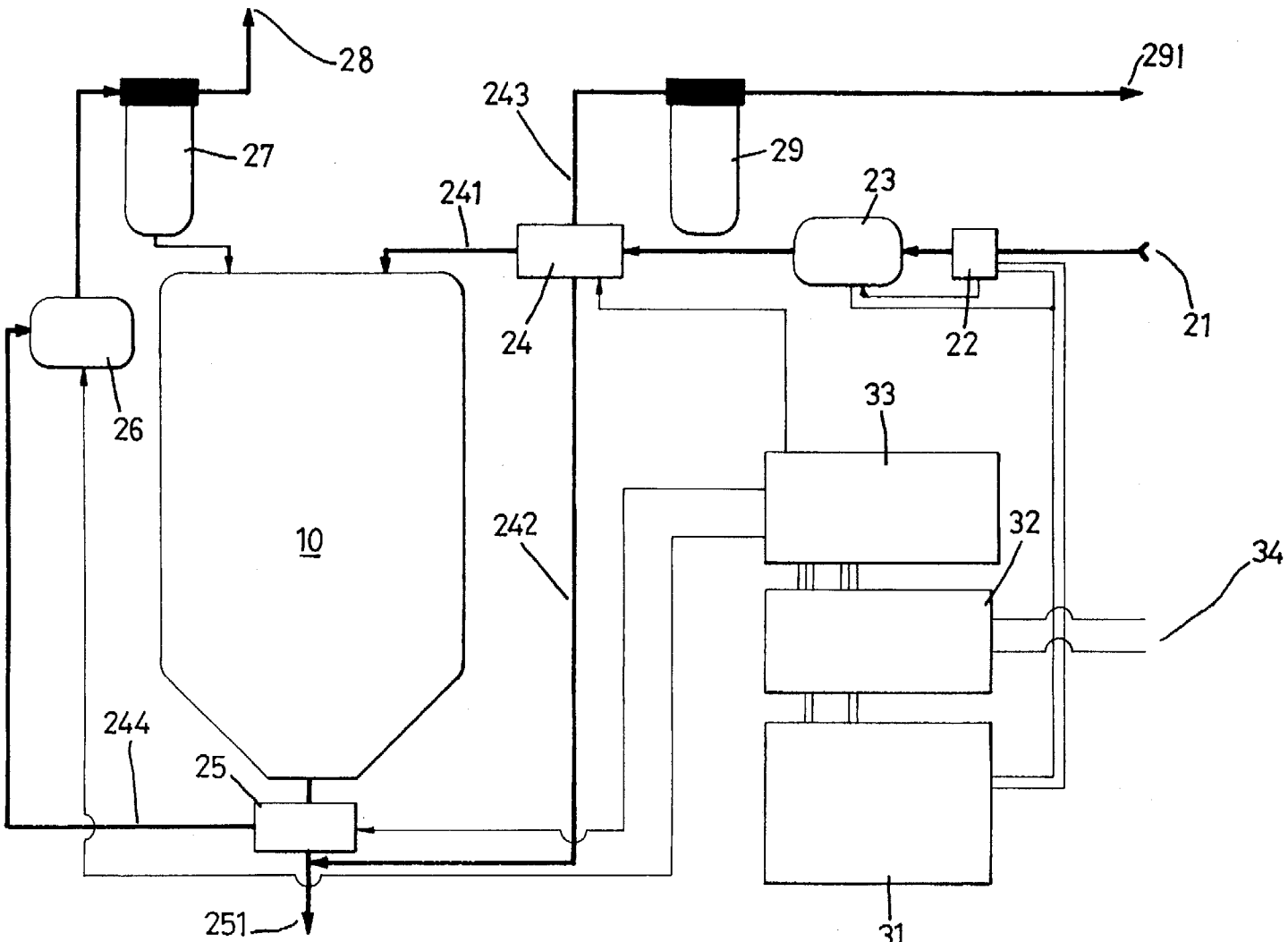
FIG. 1 is a flow diagram showing the process of recovering polishing slurry and deionizing water for a chemical mechanical polishing machine according to the present invention.

Referring to FIG. 1, the recovery device for polishing slurry and deionizing water for a chemical mechanical polishing machine according to the present invention is adapted to a chemical mechanical polishing machine, and is composed of a first pump 23 and a second pump 26, a plurality of electromagnetic valves 24 and 25, filters 27 and 29, a polishing slurry storage tank 10 and a control electronic unit. The control electronic unit is composed of a power supply 31, a timer/relay control panel 32 and a control panel for the electromagnetic valve 33. The timer/relay control panel 32 receives signals 34 from the chemical mechanical polishing (CMP) machine to determine the status of chemical mechanical polishing machine, i.e. to determine whether the chemical mechanical polishing machine is working or not being used, to control the electromagnetic control panel 33. The plurality of electromagnetic valves 24 and 25 are controlled by the electromagnetic control panel 33 to determine their closing or opening, or to determine the flow direction of the fluid flowing therethrough. The power supply 31 supplies the power needed to drive a flow rate sensor 22 and the pump 23. One end of the flow rate sensor 22 is connected to the waste liquid conduit 21. When the flow rate sensor 22 detects that the waste liquid (the used polishing slurry) is flowing out from the chemical mechanical polishing machine, it switches on the pump 23 to pump the waste liquid to the first electromagnetic valve 24. The first electromagnetic valve 24 has three outlets respectively connected to conduits 241, 242 and 243. Conduits 241, 242 and 243 are respectively connected to the polishing slurry storage tank 10, a drain outlet 251 and the filter 29 for deionizing water. A second electromagnetic valve 25 is disposed under the storage tank for the polishing slurry 10, and is connected with the storage tank via a conduit. The second electromagnetic valve 25 has two outlets separately linked to the drain outlet 251 and to the pump 26 which delivers the waste liquid (the used polishing slurry) to the filter 27 for the polishing slurry. The second electromagnetic valve 25 is controlled by the electromagnetic valve control panel 33 to determine whether the waste liquid (the used polishing slurry) should be drained out, or should be recovered and delivered to the filter 27 for the polishing slurry. After the filtration by the filter 27 for the polishing slurry, the used polishing slurry is delivered back to inlet of the chemical mechanical polishing machine. The deionizing water is delivered to a recovery system after filtration by the filter 29 for the deionizing water.

In practice, when the chemical mechanical polishing machine sends a signal for supply of the polishing slurry and the timer/relay control panel 32 receives the signal, the electromagnetic valve control panel 33 opens the first electromagnetic valve 24 and the second electromagnetic valve 25 and switches on the pump 26. The used polishing slurry (waste liquid) is delivered from the waste liquid conduit 21, via the flow rate sensor 22, the pump 23, the first electromagnetic valve 24 and conduit 241 to the storage tank for the polishing slurry 10. Simultaneously, the used polishing slurry is delivered from the storage tank for the polishing slurry 10, via the second electromagnetic valve 25, the pump 26 to the filter for the polishing slurry 27. After filtering, the used polishing slurry is recovered and send back to the inlet 28 of the chemical mechanical polishing machine. Additionally, the recovered polishing slurry may be mixed with fresh polishing slurry, then be together delivered to the chemical mechanical polishing machine.

When the chemical mechanical polishing machine is not being used, the deionizing water is continuously added to keep the wetness of the polishing pad, the timer/relay control panel 32 receives the corresponding signals from the chemical mechanical polishing machine and switches the first electromagnetic valve 24 to conduit 243, thus the used deionizing water from the chemical mechanical polishing machine flows through flow rate sensor 22, the pump 23, the first electromagnetic valve 24 and the conduit 243 to the filter 29 for deionizing water. After filteration, the used deionizing water is sent through outlet 291 to a recovery system for deionizing water.

In the case where the polishing slurry and deionizing water need not to recovered, the electromagnetic valve control panel 33 selects the electromagnetic valve 24 to open the outlet connected to the conduit 242, thus the used polishing slurry and deionizing water are directly drained out from the drain outlet 251. Further, the timer/relay control 32 can set a recovering percentage (from 0 to 100%) of the used polishing slurry and deionizing water to obtain an economical efficacy. In the case of cleaning the polishing slurry storage tank 10, the electromagnetic valve control panel 33 can select the outlet connected to the drain outlet 251 to drain out all the polishing slurry therein.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A recovery device for a polishing agent and deionizing water for a polishing machine fitted to a drain conduit of a waste polishing agent produced from the polishing machine, comprising:

a control electronic unit, which receives signals from said polishing machine to control a control valve;

a storage tank for said polishing agent, which receives said waste polishing agent from said drain conduit;

a first filter for polishing agent, which filters said waste polishing agent from said storage tank; after filtration, said filtered waste polishing agent is sent back to said polishing machine;

a second filter for deionizing water, which receives and filters said deionizing water from said polishing machine; after filtration, said deionizing water is sent to a recovery system for deionizing water;

a plurality of control valves which are separately disposed between said polishing machine and said storage tank for said waste polishing agent, and at an outlet of said storage tank for said waste polishing agent, and which are controlled by said control electronic unit.

2. The recovery device for claim 1, wherein a pump is disposed at the drain conduit for auto-detecting and controlling a flow rate of the drain conduit.

3. The recovery device for claim 1, wherein the control valve is an electromagnetic valve.

4. The recovery device for claim 1, wherein the control valve between the polishing machine and the storage tank is a multi-outlet control valve which is separately connected to the second filter for deionizing water.

5. The recovery device for claim 1, wherein the control valve connected to the outlet of the storage tank is controlled by a pump connected the control electronic unit.

6. The recovery device for claim 1, wherein the control electronic unit comprises a power source, a timer and a relay control panel, which receives signals from the polishing machine to control the control valves.

* * * * *